US009407030B2

(12) United States Patent
Zanotto et al.

(10) Patent No.: US 9,407,030 B2
(45) Date of Patent: Aug. 2, 2016

(54) METHOD OF PRODUCING FLEXIBLE ELECTRICAL CORDS AND CONNECTOR THEREFOR

(71) Applicant: OSRAM GmbH, Munich (DE)

(72) Inventors: Alberto Zanotto, Padua (IT); Simon Bobbo, Chirignago (IT); Lorenzo Roberto Trevisanello, Abano Terme (IT); Franco Zanon, Cassola (IT); Matteo Caldon, Vigonovo (IT)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/371,738

(22) PCT Filed: Jan. 11, 2013

(86) PCT No.: PCT/EP2013/050504
§ 371 (c)(1),
(2) Date: Jul. 11, 2014

(87) PCT Pub. No.: WO2013/104766
PCT Pub. Date: Jul. 18, 2013

(65) Prior Publication Data

US 2014/0342615 A1 Nov. 20, 2014

(30) Foreign Application Priority Data

Jan. 13, 2012 (IT) ..... TO2012A0024

(51) Int. Cl.
*H01R 13/516* (2006.01)
*H01R 24/20* (2011.01)
(Continued)

(52) U.S. Cl.
CPC ..... *H01R 13/516* (2013.01); *H01B 13/0006* (2013.01); *H01B 13/0036* (2013.01);
(Continued)

(58) Field of Classification Search
USPC ..... 439/626, 730, 523, 741, 274, 207, 439/733.1, 587, 444, 481; 174/88 R, 95, 481
See application file for complete search history.

(56) References Cited

U.S. PATENT DOCUMENTS 3,181,102 A 4/1965 Fehr, Jr
4,364,621 A * 12/1982 Janvrin ..... H01R 13/521 439/595

(Continued)

FOREIGN PATENT DOCUMENTS

CN 101341632 A 1/2009
CN 101852413 A 10/2010
GB 1103307 A 2/1968

OTHER PUBLICATIONS

Chinese Office Action based on Application No. 201380005105.X(5 Pages) dated Nov. 17, 2015.

(Continued)

*Primary Examiner* — Alexander Gilman
(74) *Attorney, Agent, or Firm* — Viering, Jentschura & Partner mbB

(57) ABSTRACT

A method of producing cut-to-length flexible electrical cords includes providing a flexible strip having a plurality of electrically conductive lines extending along the strip, arranging along said strip a plurality of electrical connectors including a plurality of tubular electrical conductors extending in a bridge-like manner between two subsequent portions of one of the conductive lines of said plurality, separating a portion of a given length from said flexible strip by cutting at least one said connector in a transverse plane, thus cutting the plurality of tubular electrical conductors in the cut connector, whereby said portion separated from said flexible strip forms a flexible electrical cord having, at one end at least, a plurality of electrical connection holes or sockets exposed as a result of the cutting of said tubular conductors.

13 Claims, 3 Drawing Sheets

(51) Int. Cl.

| | |
|---|---|
| ***H01R 25/14*** | (2006.01) |
| ***H01B 13/00*** | (2006.01) |
| *H01R 12/61* | (2011.01) |
| *H01R 107/00* | (2006.01) |

(52) U.S. Cl.
CPC ..... *H01R24/20* (2013.01); *H01R 25/142* (2013.01); *H01R 25/145* (2013.01); *H01R 12/61* (2013.01); *H01R 2107/00* (2013.01); *Y10T 29/49117* (2015.01)

(56) References Cited

U.S. PATENT DOCUMENTS

| | | | | |
|---|---|---|---|---|
| 4,447,109 | A * | 5/1984 | Hobart, Jr. | H01R 4/028 439/851 |
| 4,717,354 | A * | 1/1988 | McCleerey | H01R 4/20 439/444 |
| 5,367,122 | A | 11/1994 | de Olano | |
| 6,604,403 | B1 * | 8/2003 | Eslambolchi | H01R 43/042 29/282 |
| 6,676,447 | B1 * | 1/2004 | Knox | H01R 13/523 439/274 |
| 7,174,633 | B2 * | 2/2007 | Onuma | H01R 4/04 29/854 |
| 7,241,185 | B1 * | 7/2007 | Cecil | H01R 4/646 439/523 |
| 7,896,712 | B2 * | 3/2011 | Cecil | H01R 4/20 439/523 |
| 9,106,068 | B2 * | 8/2015 | Barna | H02G 3/32 |
| 2004/0218395 | A1 | 11/2004 | Westerheide | |
| 2010/0203757 | A1 | 8/2010 | Mostoller et al. | |

OTHER PUBLICATIONS

International Search Report issued in PCT/EP2013/050504 dated Mar. 6, 2013.

* cited by examiner

METHOD OF PRODUCING FLEXIBLE ELECTRICAL CORDS AND CONNECTOR THEREFOR

RELATED APPLICATIONS

The present application is a national stage entry according to 35 U.S.C. §371 of PCT application No. PCT/EP2013/050504 filed on Jan. 11, 2013, which claims priority from Italian application No. TO2012A000024 filed on Jan. 13, 2012, and is incorporated herein by reference in its entirety.

TECHNICAL FIELD

Various embodiments relate to the production of flexible electrical cords.

Various embodiments may relate to the production of flexible electrical cords which can be used, for example, in combination with LED light sources.

BACKGROUND

In this field, use is made of flexible electrical cords (sometimes known as "flex") with protective coatings, for which an electrical connection has to be made at specified lengths. For this purpose, it is usually necessary to remove the protective coating and then fit the connectors. In this process it is difficult to maintain a sufficient degree of protection against the ingress of solid bodies (including parts of the human body such as hands and fingers), dust, water, and accidental contact, in order to meet the requirements, for example, of the IP (International Protection) classes of protection as defined in the DIN EN 60529 standard.

In various applications, the connectors may be rather cumbersome, and, in the case of application to light sources such as LEDs, there may be a risk of damage to a lighting module as a result of the removal of a connector.

SUMMARY

It is therefore necessary to provide solutions for producing flexible electrical cords which can be used, for example, in combination with light sources such as LED light sources, and which can be cut to length while retaining the characteristics of the protective coating regardless of the dimensions, while also providing simple connection to the light sources. The whole arrangement is such that the IP classes of protection can be retained even after the operation of cutting to length.

Various embodiments provide a method and a corresponding connector.

Various embodiments can be used for producing flexible cords cut to length and provided, at one end at least, with a connector capable of supplying power by connection to a standard plug connector, the whole arrangement being such that no additional operations are required.

Various embodiments enable one or more of the following advantages to be obtained:

simple and economical cutting and connection;

guaranteed retention of the IP classes of protection;

the possibility of carrying out the operation of cutting to length in a continuous way, without needing to stop the production line in order to cut a single cord to length;

the reduction of the dimensions of the connection system.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

The following description illustrates various specific details intended to provide a deeper understanding of the embodiments.

The embodiments may be produced without one or more of the specific details, or may use other methods, components, materials, etc. In other cases, known structures, materials or operations are not shown or described in detail, in order to avoid obscuring various aspects of the embodiments.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in any suitable way in one or more embodiments.

The references used herein are provided purely for convenience and therefore do not define the scope of protection or the extent of the embodiments.

In the appended drawings, the numerical reference 10 indicates, in various embodiments, an electrical connector usable for producing flexible electrical cords of the type sometimes known as "flex", cut to length and provided, at one end at least, with an electrical connector designed to allow connection to a plug connector C.

In various embodiments, a connector or plug of this type (which is known in itself) can have a box-like body with a certain number of pins C1 which project from the base wall inside the box-like body and are connected to corresponding electrical wires C2.

Figure 6:
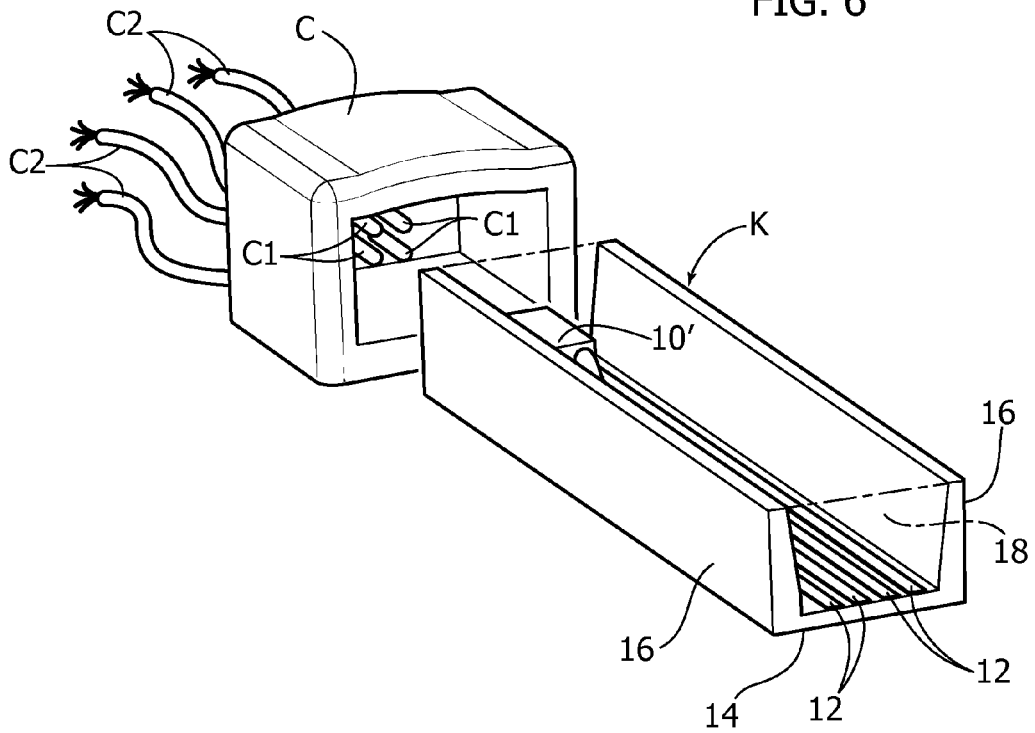
FIGS. 6 and 7 show the procedures for connecting a flexible electrical cord according to some embodiments.

In the embodiment to which FIG. 6 relates, four pins C1 are shown, connected to the vertices of a square member in a substantially central position relative to the base wall of the box-like body. The plug C is designed to be connected to a flexible cord K, which is assumed to be of indeterminate length and which carries at one of its ends a connector 10' (the reason for this term will become clear in the following text) having four sockets 100.

When the end of the flexible cord K carrying the connector 10' is coupled to the plug C, the four sockets form corresponding cylindrical, or more generally tubular, cavities for receiving the pins C1 which are inserted into them.

As will become apparent from the following text, the sockets 100 of the connector 10' are connected to corresponding conductive lines (or tracks) 12 applied (using known lamination methods, for example) to a strip-like substrate 14 of the cord K.

Figure 5:
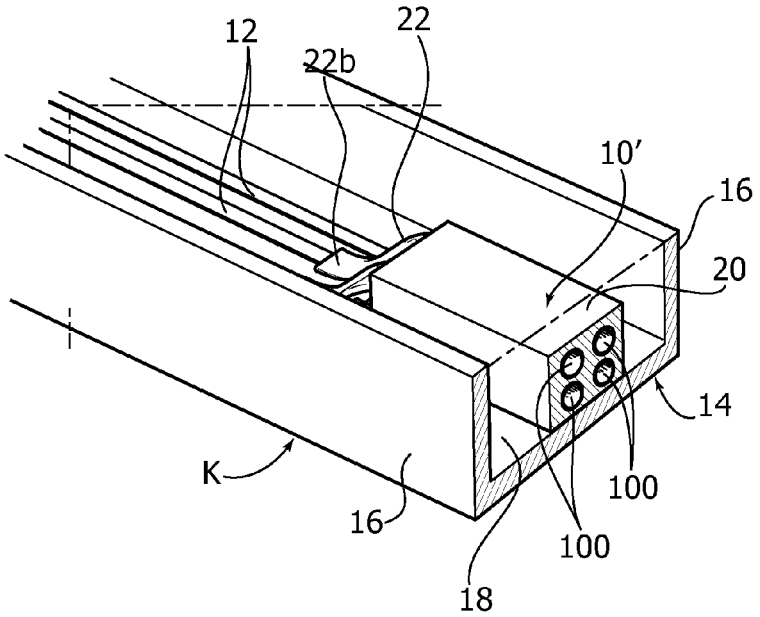
Figure 7:
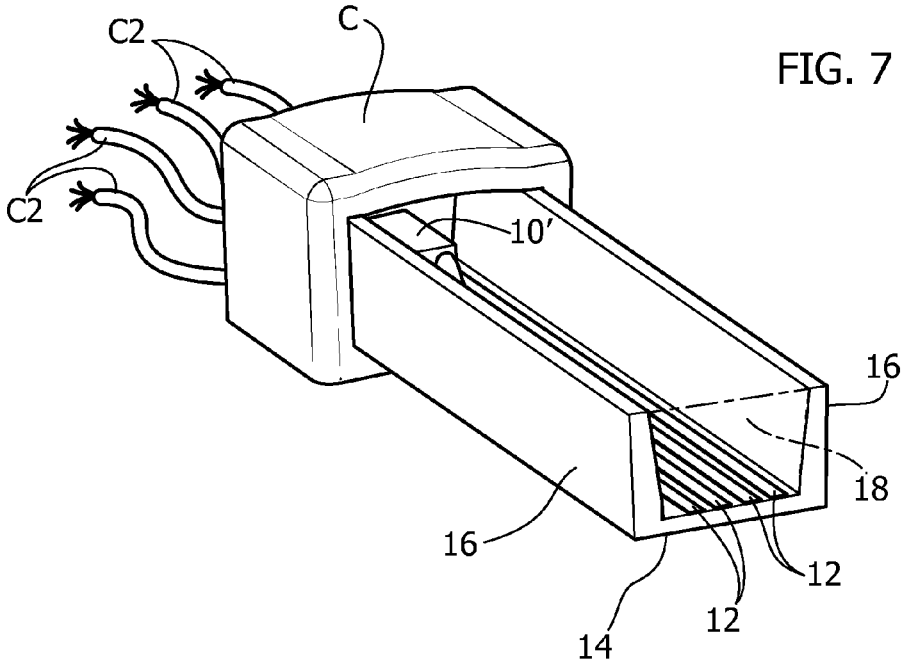

As is shown in FIGS. 5 to 7 only, for reasons of simplicity of illustration, in various embodiments the body of the cord K is shaped overall in the form of a channel in which it is possible to identify a core wall defined by the strip 14, on which the lines 12 are located, and two end walls 16. In this arrangement the volume of the inner cavity of the channel shape is filled with an insulating material 18 designed to protect the conductive lines 12 provided on the strip-like substrate 14 so as to provide electrical protection of the lines 12, in accordance with the IP standards for example.

In various embodiments, cords K of the type considered herein can be produced from a continuous strip (of virtually indeterminate length), in which the substrate 14, with the lines 12 formed on the surface of the substrate 14 facing the inside of the channel shape, the side walls 16, and the protective coating 18 which occupies the inner volume of the channel shape are all present as separate parts or as elements integrated with each other.

FIGS. 4 to 7 refer, purely by way of example, to the possible presence of four conductive lines 12. In the case of a lighting system (such as a lighting system using sources of light radiation of the LED type), four lines 12 can be used, respectively, as a common ground line and as three "signal" lines for providing respective power supplies to sources of light radiation having different color characteristics (such that they form an RGB color system, for example), thus making it possible to vary the color temperature (or, more generally, the color) of the radiation generated by the set of sources of light radiation.

Various embodiments may include only two conductive lines 12, such that power can be supplied to one or more light sources by identical procedures.

In various embodiments, the presence of three lines 12 may allow one or more light sources to be supplied with two signals relative to the common ground line, with the first signal forming a power signal (of the direct current type, for example) while the second signal forms a control signal (for providing a light intensity regulation function, known as a "dimming" function, for example) using "intelligent" circuits associated with the light sources.

Various embodiments may also entirely dispense with the specified number of conductive lines 12 present and/or the specific procedures for producing the cord K. Similarly, the reference made herein to LED sources of light radiation, or more generally to applications for lighting technology of the SSL (solid state lighting) type, is provided purely by way of example.

Various embodiments may refer primarily to the procedures for producing the connectors 10. Various embodiments have the purpose of making it possible to produce flexible electrical cords cut to length with a wide range of choices of length. For this purpose, the starting point in various embodiments may be a flexible strip of indeterminate length such as the strip-like substrate 14 along which the conductive lines 12 extend. In various embodiments, as mentioned above, the strip 14 acting as the substrate can be associated with side walls 16 and the coating 18: it will be appreciated, however, that the presence of these elements or the specific procedures for producing them are not essential features of various embodiments.

In various embodiments, electrical connectors 10 can be placed along the aforesaid strip 14, in positions determined by the desired interval for the choice of the length of flexible cord to be produced.

In various embodiments, the connectors 10 can comprise a body 20 of insulating material in which a plurality of tubular conductors 22 extends.

In various embodiments, the conductors 22 (see, in particular, the view in FIG. 4) can be mounted on the strip 14 so as to connect in a bridge-like manner two successive portions of one of the (two or more) lines 12.

In various embodiments, the tubular conductors 22 (which can be made from light metal, for example) may be embedded in the material (for example, an insulating plastic material) of the body 20.

In various embodiments, the conductors 22 may have a central portion 22*a* of tubular shape in the strict sense (having a circular cross section, for example) and two end portions 22*b*, of flattened shape, which can each be applied in electrical contact to a corresponding conductive line 12 in order to produce an electrical contact (for example, a contact bonded by soldering) with the conductive line 12 in question.

Figure 3:
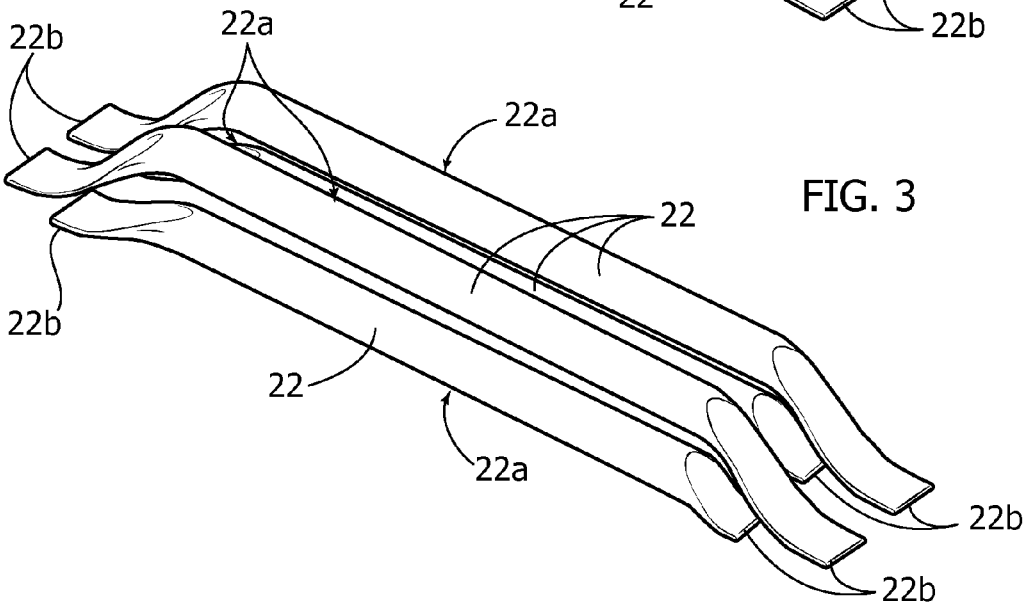
FIG. 3 shows a detail of the connector of FIG. 2.

As shown more fully in the view of FIG. 3, in various embodiments the tubular conductors 22 may have a shape which can be defined approximately as a n or "mesa" shape, with the intermediate portion 22*a* extending along a rectilinear or substantially rectilinear path and the two flattened end portions 22*b* curved in such a way that each of them comes into contact with a corresponding conductive track 12.

Figure 1:
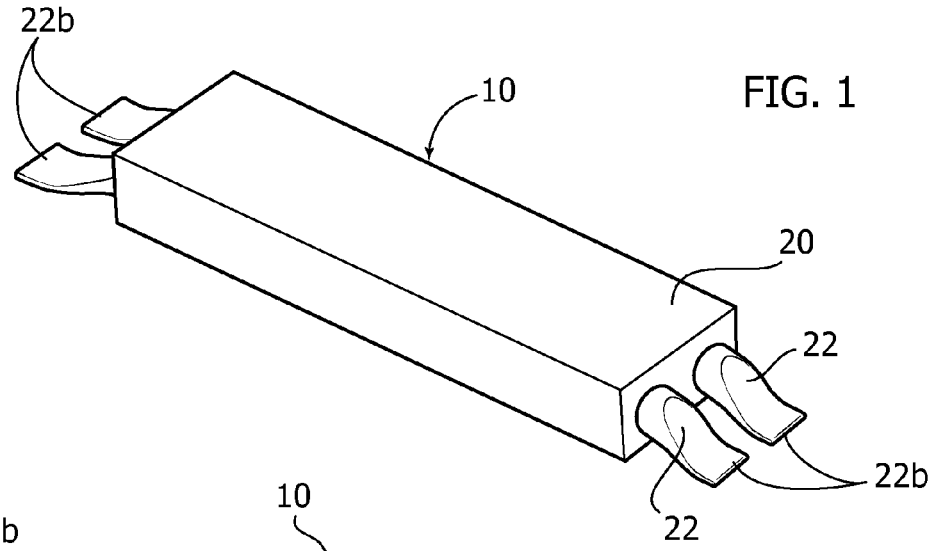
FIGS. 1 and 2 show a connector according to various embodiments.

FIG. 1 shows an example of possible embodiments in which two conductors 22 are present in a connector 10 designed to provide a connection between successive portions of two conductive lines 12 formed on the substrate 14.

Figure 2:
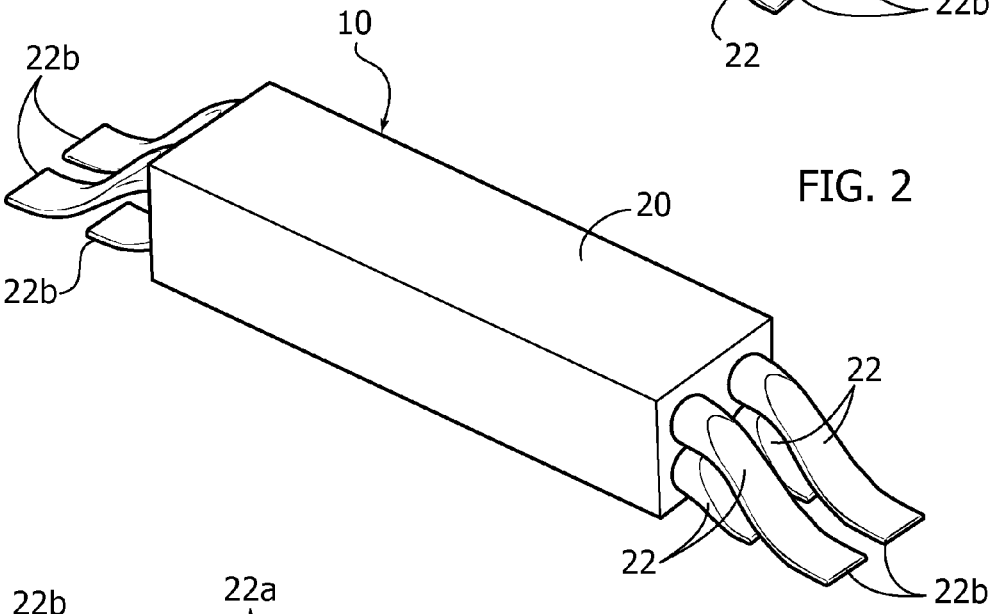

FIG. 2 shows an example of possible embodiments in which two conductors 22 are present in a connector 10 designed to provide a connection between successive portions of four conductive lines 12 formed on the substrate 14. In this case, four conductors 22 are present in the connector 10 designed to provide a connection between successive portions of four conductive lines 12 formed on the substrate 14. The same four tubular conductors 22 are shown in the "bare" state in FIG. 3, which can be seen as being based on FIG. 2 with the removal of the body or casing 20 of the connector 10.

In various embodiments, the tubular conductors 22 (or more precisely the intermediate or central portions 22*a*) may be ordered, so to speak, on two planes (or levels or layers), in which:

the first plane comprises two adjacent conductors 22, and the second plane comprises two adjacent conductors 22, with each conductor of the second plane aligned with a conductor 22 of the first plane.

The spatial distribution of the conductors 22 described here by way of example can be generalized both as regards the number of conductors included on each plane and in relation to the number of planes on which the conductors are arranged.

This may take place, for example, in accordance with the specific connection requirements that are to be met (particularly as regards the number of lines or tracks 12 present).

It will be appreciated that the arrangement on a plurality of planes is not in any way dependent on the presence of "identical" planes. For example, in a solution essentially related to that shown in FIGS. 2 and 3, two conductors 22 and a single conductor or three conductors may be present on respective planes of the two planes.

Figure 4:
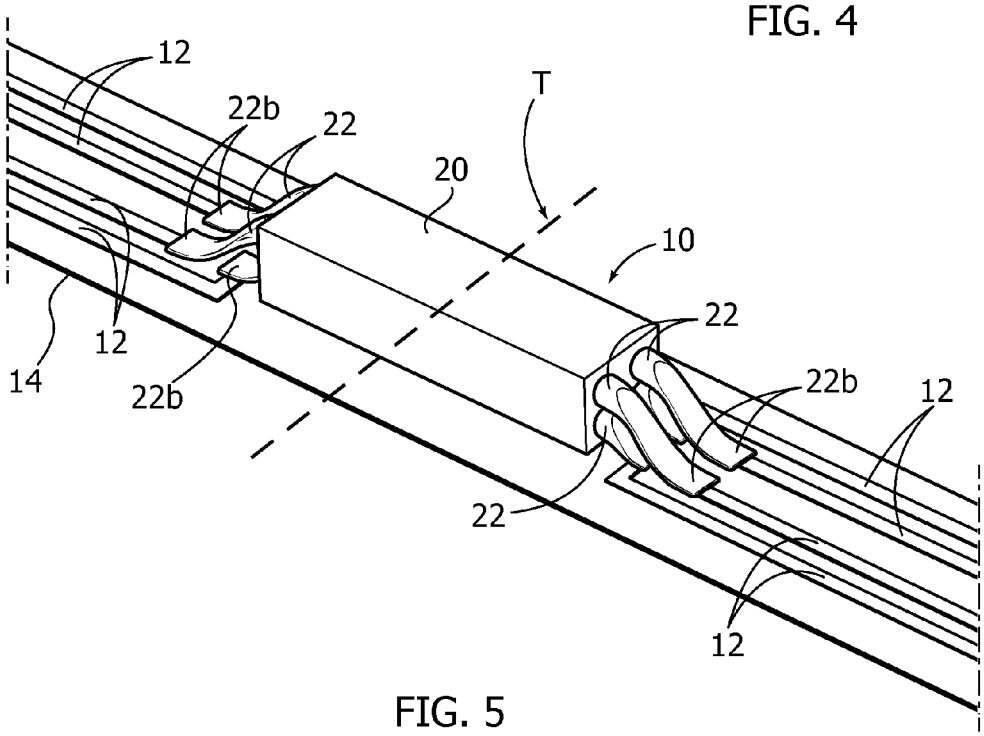
FIGS. 4 and 5 show successive steps of a method according to some embodiments.

As shown in FIG. 4, the presence of a connector 10 in given positions distributed along the support strip 14 makes it possible to produce a conductive line of unlimited length which can be cut into successive portions. The result of all these arrangements is to provide flexible electrical cords K produced by segmenting the aforesaid line of indeterminate length at transverse planes such as the plane indicated by T in FIG. 4.

The cutting operation, shown schematically in FIG. 4, is assumed in this case to take place in a transverse median plane T relative to the connector 10; however, this operation can be carried out in any intermediate plane of the connector.

The operation of segmentation, or "cutting to length", carried out in a plane T transverse to the general direction of extension of one of the connectors 10 has two outcomes:

in the first place, it leads to the formation of an end of a flexible electrical cord K whose length can be determined by selecting the connector 10 at which the cutting operation is performed and (with the possibility of further refinement) by varying the specific position of the cutting plane T in the selected connector 10, and in the second place, the cut results in the segmentation of the tubular conductors 22 (and in particular the intermediate sections 22*a* thereof) with the consequent formation, from the connector 10 (in its "complete" form as shown in FIGS. 1 to 4), of a "half" connector 10' (as shown in FIGS. 5 to 7), thus creating for all practical purposes a female plug in which the conductors 10, cut in half by the segmentation operation illustrated in FIG. 4, have been formed into four holes or sockets capable of receiving pins such as the pins C1 of a male plug C of the type shown in FIGS. 6 and 7.

In various embodiments, the cutting operation shown schematically in FIG. 4 may be performed at only one or both of the ends of a flexible cord K produced from the strip of indeterminate length shown in FIG. 4.

In the first case (where the cutting operation is performed at only one end of a connector 10), the result will be a flexible cord K having a female connector or plug 10', as shown by way of example in FIGS. 6 and 7, at only one of its ends, with the other end formed in any section of the strip 12 (not necessarily at the position of a connector 10), for example as the result of a connection of the lines 12 formed by soldering.

In the second case (where the cutting operation is performed at both ends of a connector 10), the result will be a flexible cord K having a female connector or plug 10' at each of its two ends, as shown by way of example in FIGS. 6 and 7.

In various embodiments, the presence of the flattened ends 22*b* in the tubular conductors 22 not only facilitates the connection with the lines or tracks 12 but can also prevent contamination by the coating material 18: this is because the flattened ends prevent the undesired penetration of this material, usually applied in the fluid state, into the tubular cavities of the conductors 22.

The cutting operation shown in FIG. 4 can also be performed with a very simple tool such as a small saw, and is such that it does not cause damage to the connector or to the portion of flexible cord with which the connector is associated.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A method of producing cut-to-length flexible electrical cords, the method comprising:

providing a flexible strip having a plurality of electrically conductive lines extending along the strip, arranging along said strip a plurality of electrical connectors including a plurality of tubular electrical conductors extending in a bridge-like manner between two subsequent portions of one of the conductive lines, separating a portion of a given length from said flexible strip by cutting at least one said connector in a transverse plane, thus cutting the plurality of tubular electrical conductors in the cut connector, whereby said portion separated from said flexible strip forms a flexible electrical cord having, at one end at least, a plurality of electrical connection holes or sockets exposed as a result of the cutting of said tubular conductors.

2. The method as claimed in claim 1, further comprising providing electrical connectors comprising blocks of insulating material, carrying said tubular conductors.

3. The method as claimed in claim 1, further comprising providing said tubular conductors with an intermediate tubular portion and two flattened end portions connected to said two successive portions of one of the conductive lines of said plurality.

4. The method as claimed in claim 3, including providing said tubular conductors with a mesa shape in which said intermediate tubular portion is rectilinear and said flattened end portions are curved so as to come into contact with said two successive portions of one of the conductive lines of said plurality.

5. The method as claimed in claim 1, further comprising providing said flexible strip with a protective coating to cover said plurality of conductive lines.

6. The method as claimed in claim 5, further comprising providing said flexible strip, which has a channel-shaped structure, with said protective coating, which fills a cavity of said channel-shaped structure.

7. The method as claimed in claim 1, further comprising providing two adjacent conductive lines on said flexible strip and two adjacent tubular conductors in said connectors.

8. The method as claimed in claim 1, further comprising providing four adjacent conductive lines on said flexible strip and four said tubular conductors in said connectors.

9. An electrical connector for use to produce cut-to-length flexible electrical cords, the connector comprising, a support block of an electrically insulating material having a plurality of tubular electrical conductors extending along said support block, said support block comprising:

a flexible strip having a plurality of electrically conductive lines extending along the strip, a plurality of electrical connectors extending in a bridge-like manner between two subsequent portions of one of the conductive lines being arranged along said strip, a portion of a given length from said flexible strip configured to separate by cutting at least one said connector in a traverse plane, whereby said portion separated from said flexible strip forms a flexible electrical cord having, at least, a plurality of electrical connection holes or sockets exposed as a result of the cutting of said tubular conductors, wherein said support block and said tubular conductors are adapted to be cut in a plane transverse to the support block to form said plurality of electrical connection holes or sockets exposed as a result of the cutting of said tubular connectors.

10. The connector as claimed in claim 9, wherein said tubular conductors have an intermediate tubular portion and two flattened end portions which can be connected to said two successive portions of one of the plurality of conductive lines.

11. The connector as claimed in claim 10, wherein said tubular conductors are mesa-shaped with said intermediate tubular portion rectilinear and said flattened end portions curved so as to come into contact with said two successive portions of one of the conductive lines of said plurality.

12. The connector as claimed in claim 9, further comprising two adjacent tubular conductors.

13. The connector as claimed in claim 9, further comprising four adjacent tubular conductors.

* * * * *